US009822633B2

(12) United States Patent
Sugiura

(10) Patent No.: US 9,822,633 B2
(45) Date of Patent: Nov. 21, 2017

(54) ROTATIONAL DOWNLINKING TO ROTARY STEERABLE SYSTEM

(71) Applicant: Schlumberger Technology Corporation, Sugar land, TX (US)

(72) Inventor: Junichi Sugiura, Bristol (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 208 days.

(21) Appl. No.: 14/505,463

(22) Filed: Oct. 2, 2014

(65) Prior Publication Data

US 2015/0107903 A1 Apr. 23, 2015

Related U.S. Application Data

(60) Provisional application No. 61/893,891, filed on Oct. 22, 2013.

(51) Int. Cl.

| | |
|---|---|
| ***E21B 47/12*** | (2012.01) |
| ***E21B 3/00*** | (2006.01) |
| ***E21B 44/00*** | (2006.01) |
| ***E21B 7/06*** | (2006.01) |

(52) U.S. Cl.

CPC ..... *E21B 47/12* (2013.01); *E21B 3/00* (2013.01); *E21B 7/06* (2013.01); *E21B 44/005* (2013.01)

(58) Field of Classification Search

None

See application file for complete search history.

(56) References Cited

U.S. PATENT DOCUMENTS

| | | | | |
|---|---|---|---|---|
| 4,909,336 | A | | 3/1990 | Brown et al. |
| 5,099,934 | A | | 3/1992 | Barr |
| 5,265,682 | A | | 11/1993 | Russell et al. |
| 5,520,255 | A | | 5/1996 | Barr et al. |
| 5,553,678 | A | | 9/1996 | Barr et al. |
| 5,582,259 | A | | 12/1996 | Barr |
| 5,603,386 | A | | 2/1997 | Webster |
| 5,685,379 | A | | 11/1997 | Barr et al. |
| 5,695,015 | A | * | 12/1997 | Barr ..... E21B 7/04 175/45 |
| 5,706,905 | A | | 1/1998 | Barr |
| 6,089,332 | A | | 7/2000 | Barr et al. |

(Continued)

OTHER PUBLICATIONS

International search and written opinion for the equivalent PCT patent application No. PCT/US2014/059803 dated Jan. 19, 2015.

(Continued)

*Primary Examiner* — Jennifer H Gay
*Assistant Examiner* — Caroline Butcher

(57) ABSTRACT

A downhole steering tool comprising a first member, fixedly coupled with a drill string, and a second member, proximate the first member and rotatable substantially freely with respect to the first member. A first sensor is operable to measure a difference in rotation rates of the first and second members. A second sensor is operable to measure a substantially real-time rotation rate of the second member in the wellbore. A tool controller is operable to process sensor signals from the first and second sensors to determine a rotation rate of the drill string. Surface-initiated changes in the rotation rate of the drill string are then utilized by the downhole steering tool for steering and other control.

16 Claims, 3 Drawing Sheets

(56) References Cited

U.S. PATENT DOCUMENTS

| | | | | |
|---|---|---|---|---|
| 6,265,682 | B1 | 7/2001 | Lee | |
| 6,267,185 | B1 | 7/2001 | Mougel et al. | |
| 6,608,565 | B1 | 8/2003 | Van Steenwyk et al. | |
| 6,802,378 | B2 | 10/2004 | Haci et al. | |
| 6,816,788 | B2 | 11/2004 | Van Steenwyk et al. | |
| 6,847,304 | B1 | 1/2005 | McLoughlin | |
| 6,918,453 | B2 | 7/2005 | Haci et al. | |
| 7,096,979 | B2 | 8/2006 | Haci et al. | |
| 7,222,681 | B2 | 5/2007 | Jones et al. | |
| 7,245,229 | B2 | 7/2007 | Baron et al. | |
| 7,377,333 | B1 * | 5/2008 | Sugiura | E21B 7/06 166/66.5 |
| 7,426,967 | B2 | 9/2008 | Sugiura | |
| 7,540,337 | B2 | 6/2009 | McLoughlin et al. | |
| 7,571,643 | B2 | 8/2009 | Sugiuura | |
| 7,810,584 | B2 | 10/2010 | Haci et al. | |
| RE42,426 | E | 6/2011 | McLoughlin | |
| 8,141,657 | B2 | 3/2012 | Hutton | |
| 8,408,331 | B2 | 4/2013 | Patwa et al. | |
| 8,570,833 | B2 | 10/2013 | Sugiura | |
| 8,607,863 | B2 | 12/2013 | Fripp et al. | |
| 2006/0260843 | A1 * | 11/2006 | Cobern | E21B 47/024 175/45 |
| 2007/0107937 | A1 | 5/2007 | Sugiura | |
| 2007/0137898 | A1 | 6/2007 | Virally et al. | |
| 2008/0294344 | A1 | 11/2008 | Sugiura | |
| 2009/0050370 | A1 | 2/2009 | Peters | |
| 2012/0061148 | A1 | 3/2012 | Clausen et al. | |
| 2013/0075164 | A1 | 3/2013 | Hutton et al. | |
| 2013/0118812 | A1 | 5/2013 | Clausen et al. | |
| 2013/0126239 | A1 | 5/2013 | Panchal et al. | |
| 2015/0330210 | A1 * | 11/2015 | Lozinsky | G01V 9/00 73/152.46 |

OTHER PUBLICATIONS

International Preliminary Report on Patentability issued in corresponding International Application PCT/US2014/059803 dated Apr. 26, 2016. 9 pages.

* cited by examiner

ROTATIONAL DOWNLINKING TO ROTARY STEERABLE SYSTEM

CROSS-REFERENCE TO RELATED APPLICATIONS

This application claims the benefit of and priority to U.S. Provisional Application No. 61/893,891 entitled "Rotation Downlinking to Roll-Stabilized Control Apparatus," filed Oct. 22, 2013, the entire disclosure of which is hereby incorporated herein by reference.

BACKGROUND

Oil and gas well drilling operations may utilize logging-while-drilling (LWD) sensors to acquire logging data as a wellbore is being formed. The logging data may provide information about the progress of the drilling operation and/or the Earth formations surrounding the wellbore. Drilling operations may benefit from improved downhole sensor control from the rig floor and/or remote locations.

For example, the ability to efficiently and reliably transmit and/or receive commands from an operator to downhole drilling apparatus may benefit the precision of the drilling operation. Downhole drilling hardware—such as that which, for example, deflects and/or pushes a portion of the drill string to steer the drilling tool—may be more effective when under tight control by an operator. The ability to continuously adjust the projected direction of the wellbore path by, for example, sending commands to a downhole steering tool, may facilitate fine-tuning the projected wellbore path, perhaps based on substantially real-time survey and/or logging data.

Conventional communication techniques may rely on the rotation rate of the drill string to encode data. However, especially in deep and/or horizontal wells or when stick/slip conditions are encountered, data transmission and measurement can become difficult.

SUMMARY

This summary is provided to introduce a selection of concepts that are further described below in the detailed description. This summary is not intended to identify key or indispensable features of the claimed subject matter, nor is it intended to be used as an aid in limiting the scope of the claimed subject matter.

The present disclosure introduces an apparatus that includes a downhole steering tool conveyed in a wellbore via a drill string. The downhole steering tool includes a first member fixedly coupled with the drill string, a second member disposed proximate the first member and rotatable substantially freely with respect to the first member, a first sensor operable to measure a difference in rotation rates of the first and second members, and a second sensor operable to measure a substantially real-time rotation rate of the second member in the wellbore. The downhole steering tool also includes a tool controller operable to process sensor signals from the first and second sensors to determine a rotation rate of the drill string.

The present disclosure also introduces a method in which a drill string is conveyed in a subterranean wellbore. The drill string includes a drill bit and a steering tool. The steering tool includes a first member coupled with the drill string, a second member operable to rotate substantially freely with respect to the first member, a rotation measurement device operable to measure relative rotation rate between the first member and the second member, and a sensor operable to measure the rotation rate of the second member. The method includes rotating the drill string at a first rotation rate, and transmitting a signal to the steering tool by rotating the drill string at a second rotation rate for a first predetermined period of time. The second rotation rate is substantially different than the first rotation rate. The drill string is then rotated at a third rotation rate for a second predetermined period of time. The third rotation rate is substantially different than the first and second rotation rates.

The present disclosure also introduces an apparatus that includes a downhole steering tool conveyed in a wellbore via a drill string. The downhole steering tool includes a first member fixedly coupled with the drill string, a second member disposed proximate the first member and rotatable substantially freely with respect to the first member, a first sensor operable to measure a difference in rotation rates of the first and second members, and a second sensor operable to measure a substantially real-time rotation rate of the second member in the wellbore. The downhole steering tool also includes a tool controller operable to process sensor signals from the first and second sensors to determine a rotation rate of the drill string. The tool controller is also operable to decode an encoding language comprising codes that are represented in the encoding language as predefined sequences of varying rotation rates of the drill string to communicate with a surface location to control the downhole steering tool. The apparatus also includes or is operable in conjunction with a surface controller operable at the surface location to send downlink codes to the tool controller in the form of a predefined sequence of varying rotation rates of the drill string to control the downhole steering tool.

These and additional aspects of the present disclosure are set forth in the description that follows, and/or may be learned by a person having ordinary skill in the art by reading the materials herein and/or practicing the principles described herein. At least some aspects of the present disclosure may be achieved via means recited in the attached claims.

BRIEF DESCRIPTION OF THE DRAWINGS

The present disclosure is understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
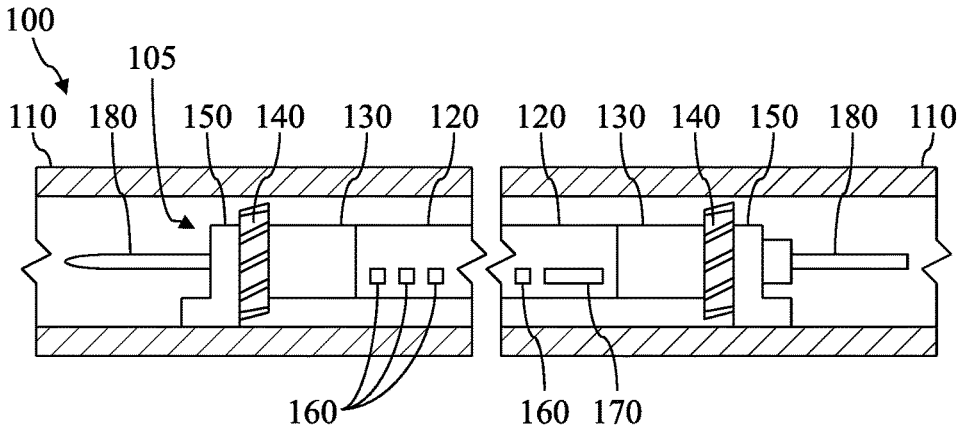
FIG. 1 is a schematic view of at least a portion of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for simplicity and clarity, and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

The present disclosure introduces a downhole tool, such as a steering tool, comprising one or more sensors operable to measure drill string rotation rates, such as collar revolutions-per-minute (RPM), perhaps including substantially instantaneous drill string rotation rates. One or more sensors may be placed in a roll-stabilized sensor housing, such as a slowly-rotating sensor housing or non-rotating sensor housing (hereinafter collectively referred to as "a roll-stabilized sensor housing"), which may be sealed and/or otherwise pressurized. A slowly-rotating sensor housing rotates at a first speed that is substantially less than a second speed at which the drill string rotates. For example, a slowly-rotating sensor housing may rotate at a speed that is less than the drill string rotation speed by at least a predetermined RPM, such as by about 50 RPM (among other examples), or at a speed that is less than a predetermined percentage of a drilling RPM, such as at least about 50% (among other examples) less than the drill string RPM. A non-rotating sensor housing maintains an azimuthal orientation independent of rotation of the drill string and/or drill bit. This downlink method may be executed while conventional mud pulse telemetry is in operation, without interrupting the uplink communication, which may thus allow simultaneous uplink and downlink communications.

The roll-stabilized housing may rotate substantially independently from the collar rotation to, for example, control the steering direction of the directional drilling tool. At a given time, the roll-stabilized sensor housing may be substantially geo-stationary or may be rotating slightly slower than (e.g., about sixteen RPM less than) the collar rotation speed, or may have substantially slow rotation speed with respect to the Earth (e.g., about four RPM). The roll-stabilized sensor housing may have additional functions to rotate at substantially different rotation speeds relative to the collar speed, such as for telemetry and/or steering operations, among other examples.

One or more aspects of apparatus within the scope of the present disclosure, and/or methods executed by and/or in conjunction with such apparatus, may regard and/or include encoding data and/or commands in a sequence of varying drill string rotation rates. For example, commands in the form of relative changes to the current toolface and/or steering ratio settings of the steering tool may be encoded downhole and subsequently transmitted. Set points for downhole, closed-loop steering algorithms, such as for target inclination, azimuth, and/or dogleg, among others, may also be encoded downhole and subsequently transmitted. This may include commands in the form of relative changes to the current set points. Other commands and/or information indicating the rate of penetration (ROP), drill bit rate of rotation, and/or drill depth may also be encoded and transmitted from the surface location to the steering tool as a sequence of varying drill string rotation rates. Certain commands may be executed by the steering tool, for example, to change the steering tool settings and, thus, the direction of drilling. Certain information may be used by the steering tool to, for example, change the direction of drilling according to preprogrammed drilling path or parameters. Example implementations may facilitate quick and/or accurate communication with the downhole tool.

The present disclosure also introduces an automated downlinking method and system for downhole tools. One or more aspects of such methods and/or systems may regard downlinking, perhaps automatically, instructions from a surface location to a steering tool and/or other downhole tool. For example, a downlinking signal transmitted downhole by varying a drill string rotation rate, standpipe pressure, and/or flow rate, perhaps utilizing drilling fluid as the communications medium.

The present disclosure also introduces apparatus and methods for communicating "hold-inclination-and-azimuth" commands to a steering tool deployed in a wellbore. Hold-inclination-and-azimuth commands may be defined as actual inclination and azimuth being continuously compared against a target inclination and azimuth (set points) and, depending on the error or difference between the target and actual values, the programmed toolface and/or steering ratio may be adjusted accordingly, such as to minimize the error or difference in the next iteration. For example, a drill string comprising a steering tool may be deployed in a wellbore. The drill string may be rotatable about a longitudinal axis, and the steering tool may comprise a roll-stabilized sensor housing that may rotate, perhaps substantially freely, in a drill collar, housing, and/or other section of the drill string. The steering tool may further comprise a first differential rotation measurement device, which may be operable to measure a difference in rotation rates between the collar and the roll-stabilized sensor housing, and a second rotation measurement device or sensor, which may be operable to measure a rotation rate of the roll-stabilized sensor housing. The second rotation measurement device may comprise one or more accelerometers, magnetometers, and/or gyroscopic sensors, including micro-electro-mechanical system (MEMS) gyros and/or others operable to measure cross-axial acceleration and/or magnetic field components.

The first differential rotation measurement device may comprise a rotation sensor on the roll-stabilized control housing and a marker on the rotating collar. The marker may be or comprise a magnet, for example, and the rotation sensor may be or comprise include a Hall-effect sensor, a fluxgate magnetometer, a magneto-resistive sensor, a MEMS magnetometer, and/or a pick-up coil, among others. Alternatively, or additionally, the rotation sensor may be or comprise an infrared sensor operable to sense a marker, such as a mirror reflecting light from a source located near the sensor. An ultrasonic sensor may also be employed with a suitable marker. It will be appreciated that multiple markers (e.g., multiple magnets) may optionally be deployed around the periphery of the collar to increase the resolution, and thus precision of recognition, of the differential rotation measurements.

The derived rotation speed of the collar, using the first and second sensor sets, may be filtered to, for example, suppress negative effects of stick-slip and torsional vibration. Such filtering may be via one or more analog filters and/or digital filters, perhaps including a non-linear filter (e.g., a median filter) and/or a linear filter (e.g., an infinite impulse response (IIR) filter and/or a finite impulse response (FIR) filter).

Aspects of such apparatus and/or methods may further entail predefining an encoding language comprising codes understandable to the steering tool. For example, the codes may be represented in the encoding language as predefined value combinations of drill string rotation variables, such as in implementations in which the drill string rotation variables may comprise first and second drill string rotation rates. Additional aspects may entail causing the drill string to rotate through a predefined sequence of varying rotation rates, such as in implementations in which the sequence may represent the commands, and perhaps causing the first rotation measurement device to measure the difference in rotation rates between the drill string and the roll-stabilized housing. Additional aspects may entail causing the second rotation measurement device to measure the rotation rate of the roll-stabilized sensor housing. Further aspects may entail processing, whether downhole or otherwise, the difference in rotation rates and the rotation rate of the roll-stabilized sensor housing to, for example, determine a rotation rate of the drill string, and then processing, whether downhole or otherwise, the rotation rate of the drill string to, for example, acquire a directional steering command The present disclosure also introduces methods and apparatus for transmitting a signal from a surface location to a steering tool of a bottom-hole assembly (BHA) located in a wellbore. Related aspects may entail a controller operable to control a rotation rate of an associated drill string at surface, such as to cause the drill string to rotate through a predefined sequence of varying rotation rates, and perhaps a downhole receiver operable to receive the signal. It should be understood that the controller may be operable to receive and decode the signal and control the rotation rate of the drill string. The controller and/or the receiver may be located within the roll-stabilized sensor housing or the steering tool.

The present disclosure also introduces methods for communicating at least one command from a surface location to a BHA located in a wellbore. Aspects of such methods may entail deploying within a subterranean wellbore a steering and/or other downhole tool comprising a first rotation measurement device operable to measure a difference in rotation rates of first and second rotating members. The steering and/or other downhole tool may further comprise a second rotation measurement device comprising one or more sensors and/or sensor sets operable to measure an absolute rotation rate of the first member. Aspects of such method may further entail predefining an encoding language comprising codes understandable to the steering and/or other downhole tool, wherein the codes may be represented in the encoding language as predefined value combinations of drill string rotation variables, such as may include first and second drill string rotation rates. Additional aspects may regard causing the drill string to rotate through a predefined sequence of varying rotation rates, perhaps causing the first rotation measurement device to measure the difference between rotation rates of the first and second members, and/or causing the second rotation measurement device to measure the absolute rotation rate of the first member. Additional aspects may regard processing, whether downhole or otherwise, the difference between the rotation rates measured as set forth above and the rotation rate of the first member to determine a rotation rate of the drill string, and perhaps processing, whether downhole or otherwise, the above-described rotation rate of the drill string, such as to acquire the command in the encoding language.

FIG. 1 is a schematic view of at least a portion of a steering tool apparatus 100 having a roll-stabilized sensor platform 105 that may be utilized in a rotary-steerable system ("RSS") according to one or more aspects of the present disclosure. The roll-stabilized sensor platform 105 may be carried in a housing 110, such as may be or comprise a drill collar and/or other section of a drill string component. A roll-stabilized pressure casing 120, which may be or comprise a non-rotating or slowly rotating sensor housing or control unit, may be disposed within the housing 110 between opposing torquers 130. The torquers 130 may be operable to apply torque to the roll-stabilized pressure casing 120, such as to hold the roll-stabilized pressure casing 120 stationary during rotation of the housing 110 or to rotate the roll-stabilized pressure casing 120 independently from the rotation of the housing 110. An impeller/turbine 140 may be coupled to or otherwise disposed adjacent or proximate each torquer 130 opposite the roll-stabilized pressure casing 120. The subassembly comprising the roll-stabilized pressure casing 120, the torquers 130, and the impellers/turbines 140 may be axially and/or radially secured and/or otherwise positioned relative to the housing 110 by bearings 150 and/or other components of the apparatus 100.

The roll-stabilized pressure casing 120 may comprise a variety of sensors 160. Such sensors 160 may comprise one or more 3-axis accelerometers, 3-axis magnetometers, gyro-sensors, shock sensors (whether for sensing lateral shock or otherwise), temperature sensors, gamma ray sensors (e.g., azimuthal), and/or other sensors. The roll-stabilized pressure casing 120 may also comprise a controller, a receiver, a processor, and/or other control circuitry 170 associated with the sensors 160 and/or the torquers 130. Electrical power for the sensors 160 and/or control circuitry 170 may be provided by the impellers/turbines 140 and/or from elsewhere in the BHA (e.g., one or more batteries), such as via one or more couplings, connectors, quick-connects, and/or other means, which are collectively referred to as connectors 180.

In operation, a drill string deployed in a subterranean wellbore may include a steering tool comprising the apparatus 100. Thus, for example, the drill string may be rotatable about a longitudinal axis, and the roll-stabilized pressure casing 120 may rotate substantially freely in the housing 110. The steering tool may include a first rotation measurement device operable to measure a difference in the rotation rates of the drill string and the roll-stabilized pressure casing 120, and a second rotation measurement device operative to measure a rotation rate of the roll-stabilized pressure casing 120. For example, the first rotation measurement device may include one or more infrared sensors, ultrasonic sensors, Hall-effect sensors, fluxgate magnetometers, magneto-resistive sensors, MEMS magnetometers, and/or pick-up coils. For example, the second rotation measurement device may include one or more accelerometers, magnetometers, and/or gyro sensors of the sensors 160, each of which may be operable to measure cross-axial acceleration/magnetic field components.

A predetermined encoding language that may be associated with such operation may comprise codes that are interpreted by and/or otherwise understandable to the steering tool. For example, the codes may be represented in the encoding language as predefined value combinations of drill string rotation variables, perhaps including first and second drill string rotation rates that are interpreted by and/or otherwise understandable to the control circuitry 170.

That is, the downlinking utilizing the encoding language may utilize at least two different drill string rotation rates. For example, one rotation rate may be utilized as a base rate, such as maintaining a first rotation rate for about one minute (or some other predetermined period of time), and subsequently utilizing a second rotation rate that is about 90%, 85%, 80%, or some other percentage of the first rotation rate. Thus, the steering tool may be operable to detect and interpret two different rotation rates, by which a binary sequence may be encoded in the different rotation rates and decoded by the steering tool.

Figure 2:
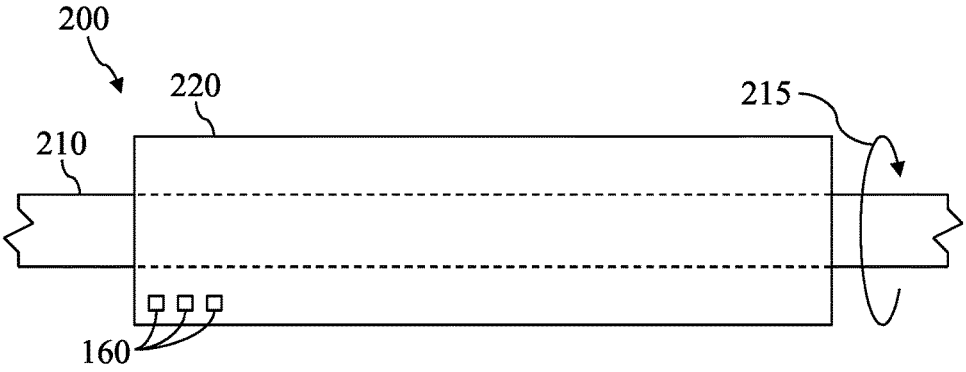
FIG. 2 is a schematic view of at least a portion of apparatus according to one or more aspects of the present disclosure

Operation may further comprise causing the drill string to rotate through a predefined sequence of varying rotation rates, where such sequence may represent or include a "hold-inclination-and-azimuth" command. The first rotation measurement device or sensor may then measure the difference in the rotation rates between the housing 110 or another part of drill string and the roll-stabilized pressure casing 120. The second rotation measurement device or sensor may measure the rotation rate of the roll-stabilized pressure casing 120. The measured difference in rotation rates and/or the measured rotation rate may then be processed downhole to determine, for example, a rotation rate of the housing 110 and, therefore, the drill string. The drill string rotation rate may be subsequently decoded by the steering tool to acquire a directional steering command, such as the "hold-inclination-and-azimuth" command FIG. 2 is a schematic view of at least a portion of a steering tool apparatus 200 disposed as part of a drill string (not shown) of an RSS according to one or more aspects of the present disclosure. The apparatus 200 may form and/or operate in conjunction with at least a portion of the apparatus 100 shown in FIG. 1, or may be a related implementation of at least a portion the apparatus 100 shown in FIG. 1.

Referring to FIGS. 1 and 2, collectively, the apparatus 200 may comprise a non-rotating or slowly rotating outer housing 220 containing the sensors 160. The outer housing 220 may or may not have steering pads and/or anti-rotation devices. A shaft 210 may extend through the outer housing 220 and rotate, as indicated by arrow 215, with a drill bit rotation speed or the drill string rotation speed, perhaps depending upon whether the outer housing 220 is located uphole or downhole of a downhole motor (not shown). When the outer housing 220 is placed between a downhole motor and a drill bit (not shown), the rotation speed of the shaft 210 may be a combination of the rotation speed of the drill string and the rotation speed of the downhole motor. In such implementations, the rotation downlink may be achieved via modulation of the flow rate of drilling fluid or "mud" to the downhole motor while the rotation speed of the drill string is substantially constant or perhaps substantially stationary. When the outer housing 220 is positioned uphole of the downhole motor and the drill bit, the rotation speed of the shaft 210 may be equal to the rotation speed of the drill string. When the drill string does not include the downhole motor, the rotation speed of the shaft 210 may be equal to the rotation speed of the drill string.

Figure 3:
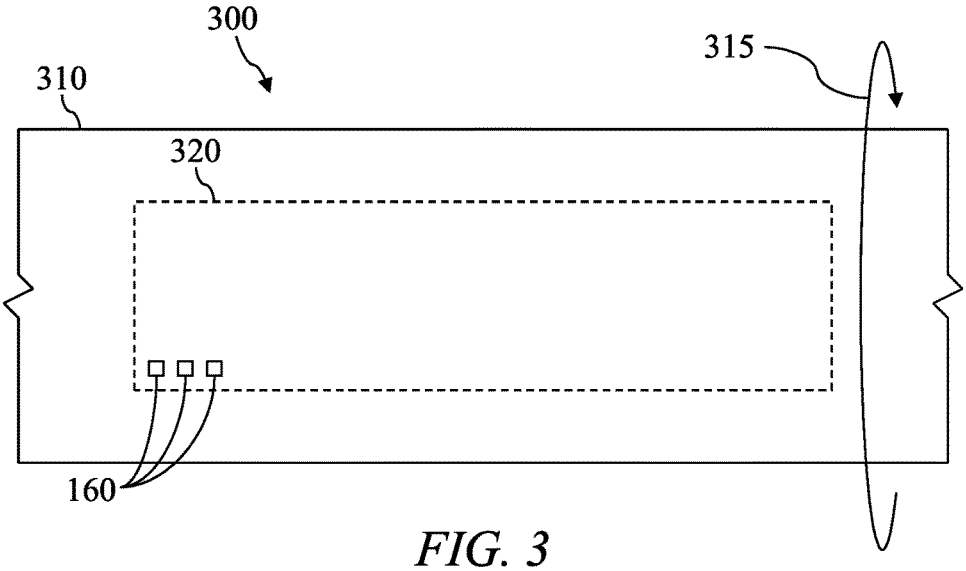
FIG. 3 is a schematic view of at least a portion of apparatus according to one or more aspects of the present disclosure.

FIG. 3 is a schematic view of at least a portion of a steering tool apparatus 300 disposed as part of a drill string (not shown) of an RSS according to one or more aspects of the present disclosure. The apparatus 300 may form and/or operate in conjunction with at least a portion of the apparatus 100 shown in FIG. 1, or may be a related implementation of at least a portion the apparatus 100 shown in FIG. 1.

FIG. 3 demonstrates that the roll-stabilized pressure casing 120, as shown in FIG. 1, may be or comprise a roll-stabilized sensor housing 320 such as, for example, a geo-stationary sensor housing, a non-rotating sensor housing, or a slowly-rotating sensor housing, wherein the roll-stabilized sensor housing 320 contains the sensors 160. Instead of (or in addition to) receiving the shaft 210 therethrough, as shown in FIG. 2, the roll-stabilized sensor housing 320 may be positioned within a drill collar 310, a portion of a drill string housing, or a portion of a steering tool housing in connection with the drill string housing, which may be (or be substantially similar to) the housing 110 shown in FIG. 1. The drill collar 310 may rotate, as indicated by arrow 315, at the rotation speed of the drill bit or the rotation speed of the drill string, perhaps depending upon whether the location is uphole or downhole of a downhole motor (not shown), in a manner similar to as described above.

Figure 4:
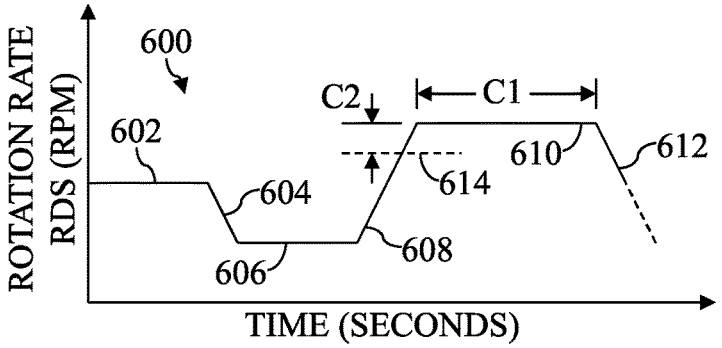
FIG. 4 is a chart demonstrating one or more aspects of the present disclosure.

FIG. 4 depicts an example rotation rate waveform for encoding a "hold-inclination-and-azimuth" command according to one or more aspects of the present disclosure. The command is represented as a combination of a predefined sequence of varying rotation rates of the drill string. Such a sequence is referred to herein as a "code sequence." The encoding scheme may define one or more codes (e.g., tool commands) as a function of one or more measurable parameters of a code sequence (e.g., the rotation rates at predefined times in the code sequence as well as the duration of predefined portions of the code sequence).

The "hold-inclination-and-azimuth" command is represented in FIG. 4 by a rotation rate waveform 600. The vertical scale indicates the rotation rate of the drill string, such as may be determined as described above, measured in revolutions per minute (RPM). The horizontal scale indicates relative time in seconds, such as may be measured from an arbitrary reference. The waveform 600 may comprise a preliminary rotation rate 602, followed by a reduction 604 of the rotation rate to a lower rate 606, which, for example, may be near zero (e.g., less than about 10 RPM), for at least a predetermined period of time prior to a rotation rate pulse 610. A pulse may be defined as an increase 608 from the lower level 606 to an elevated level 610 for at least a predetermined period of time. The pulse may be followed by a decrease 612 to the lower level 606 or another lower level. The use of a near-zero rotation rate prior to the rotation rate pulse may enable the code sequence to be further validated, which may be helpful in noisy environments, such as in the presence of stick/slip conditions.

In the example shown in FIG. 4, the waveform 600 includes a first code C1, which may be a function of the measured duration of the rotation rate pulse 610, and a second code C2, which may be a function of a difference in rotation rate between the rotation rate at the elevated level 610 and a predefined reference or command level 614, which may be a predefined rotation rate such as a wakeup rotation rate or a base drilling rotation rate. A valid "hold-inclination-and-azimuth" command may include a number of elements. For example, the preliminary rotation rate 602 may first be achieved, then a lower, perhaps near-zero, rotation rate 606 may be maintained for a predetermined period of time, perhaps ranging between about thirty seconds and about sixty seconds, although other durations are also within the scope of the present disclosure. A rotation rate greater than a predetermined level C2 (e.g., by at least about 10 RPM) above a predefined command level 614 may then be maintained for at least a predetermined time period C1, which may be about 120 seconds, among other example durations. Utilizing the lower, perhaps near-zero rotation rate 606 prior to an elevated rotation rate for a period of time may aid in preventing phantom downlink commands, such as may otherwise be due to the occurrence of stick/slip conditions.

The code sequence may also be validated or reset by maintaining a constant rotation rate of the drill string for a predetermined period of time. For example, the code may be validated by the downhole steering tool if the drill string rotates for one to two minutes at a constant rotation rate of about 100 RPM, or at another rotation rate between about 100 RPM and about 150 RPM. The period of time of each pulse and the period of time between each pulse may also vary. A pulse may be defined as period of rotation rate that is higher than a predetermined reference rotation rate. For example, each pulse may comprise about 100 RPM and each period of reduced rate may comprise about 80 RPM. Further, each pulse and each period of reduced rate of rotation may last about twenty seconds (among other possible durations, such as about fifteen seconds or about thirty seconds), whereby each code sequence may last about four to five minutes and comprise 10 to 15 pulses, or more.

In a powered (i.e., motor-assisted) RSS configuration, the flow-modulated downlink signal may be received from both the flow rate change and the collar RPM changes at one or both torquers 130 (at least in implementations in which the roll-stabilized sensors are located below the mud motor). Signal correlation from flow and RPM may both be utilized to increase the reliability of the downlink command/data. The above-described downlink protocol may be utilized in such implementations. Both flow rate and drill string speed may also be controlled at the surface to downlink distinguished commands/data to the downhole tool. Additionally, both flow rate and drill string speed may also be computer-controlled by equipment located at the surface to downlink distinguished commands/data to the downhole tool automatically, or at least partially automatically. This downlink method may be executed while conventional mud pulse telemetry is in operation for uplinking, without interrupting such uplink communications, which may allow simultaneous uplink and downlink communications.

Implementations within the scope of the present disclosure may facilitate an automated downlink communication from the surface to the downhole tool, which may reduce or remove human error related to manual downlinking. A series/sequence of commands may be remotely initiated and/or may be downlinked to a downhole steerable tool to follow a predetermined well plan.

Implementations within the scope of the present disclosure may also facilitate a downlinking method that may result in less interruption of the drilling process. Commands may be transmitted downhole while drilling (i.e., while the drill bit is rotating on-bottom), while allowing simultaneous uplink and downlink communication, and/or while a surface computer may be operable to select the base RPM, which may reduce stick-slip effects and/or modulate the surface RPM automatically to communicate with the downhole steering tool.

Figure 5:
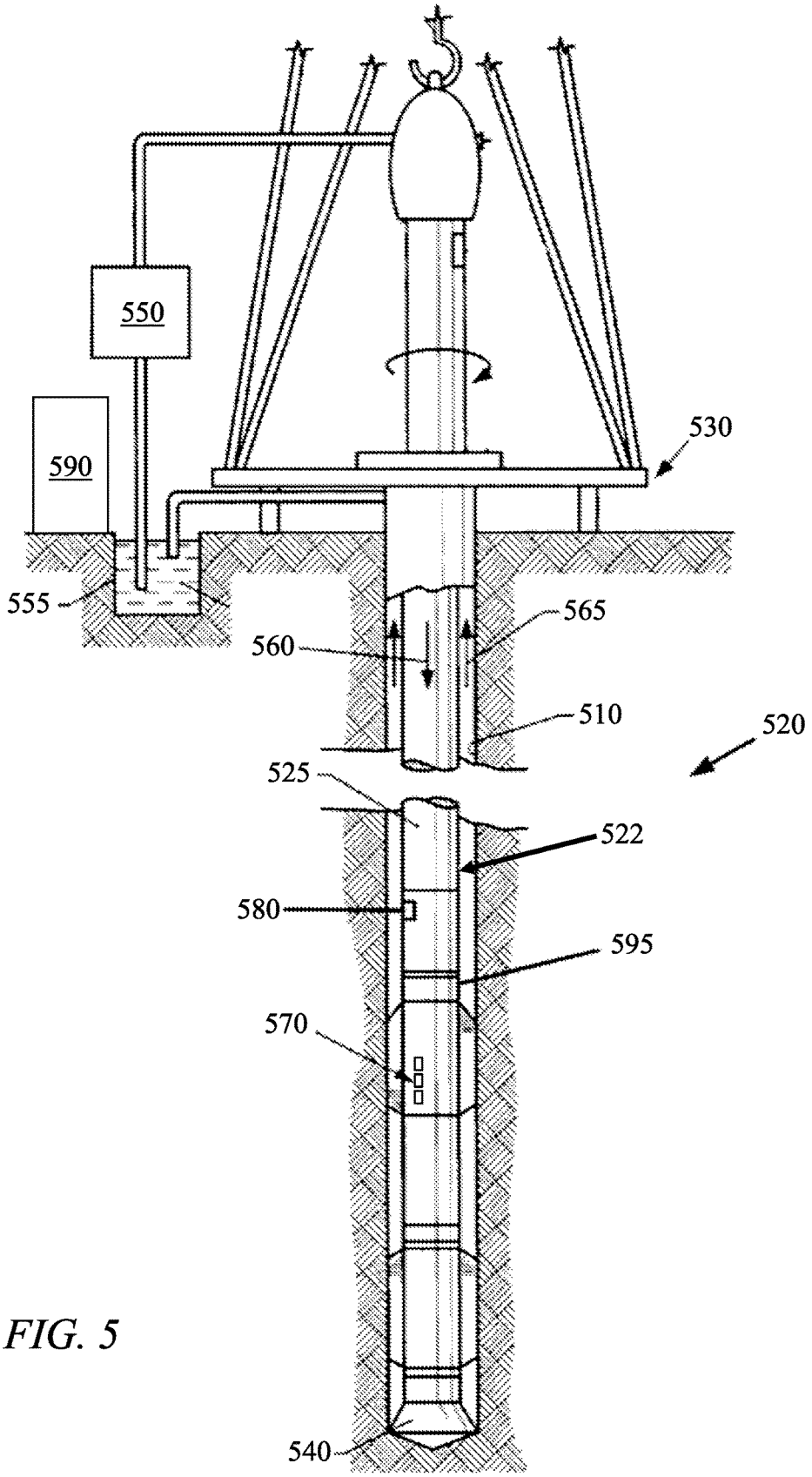
FIG. 5 is a schematic view of at least a portion of apparatus according to one or more aspects of the present disclosure.

FIG. 5 is a schematic view of an example implementation and environment in which one or more of the apparatuses 100, 200, 300 and/or methods described above may be utilized according to one or more aspects of the present disclosure. A wellbore 510 is shown being drilled through the Earth by utilizing an RSS 520 comprising a drill string 522, which includes a tool 525 having one or more aspects in common with one or more of the apparatuses 100, 200, 300 shown in FIGS. 1-3. The wellbore 510 is drilled by a drilling rig 530 operable to raise and lower the RSS 520 out of and into the wellbore 510 while turning the RSS 520. A drill bit 540 is coupled to the lower end of the RSS 520. One or more mud pumps 550 at the rig 530 lift drilling mud from a tank or storage pit 555 and pump it downhole through the interior of the RSS 520, as indicated by arrow 560. The mud travels out from nozzles (not shown) in the bit 540, and returns uphole to the surface through an annular space between the outside of the RSS 520 and the wall of the wellbore 510, as indicated by arrow 565.

The RSS 520 may comprise one or more sensors 570 adapted to make measurements of one or more properties of the formations adjacent the wellbore 510, and/or one or more drilling parameters. For example, the sensors 570 may be similar to the sensors 160 shown in FIGS. 1-3, and/or may be housed in a roll-stabilized pressure housing having one or more aspects in common with the roll-stabilized pressure casing 120 shown in FIGS. 1-3. One or more of the measurements made by the sensors 570 may be recorded, perhaps with respect to time, in a storage device 580 in the RSS 520, which may be or comprise one or more digital and/or other memories. At least a portion of the data obtained via the one or more sensors 570 may be transmitted to surface equipment 590 via operation of a mud-pulse telemetry module and/or component 595 that may form part of (or may otherwise be in communication with) the RSS 520.

Figure 6:
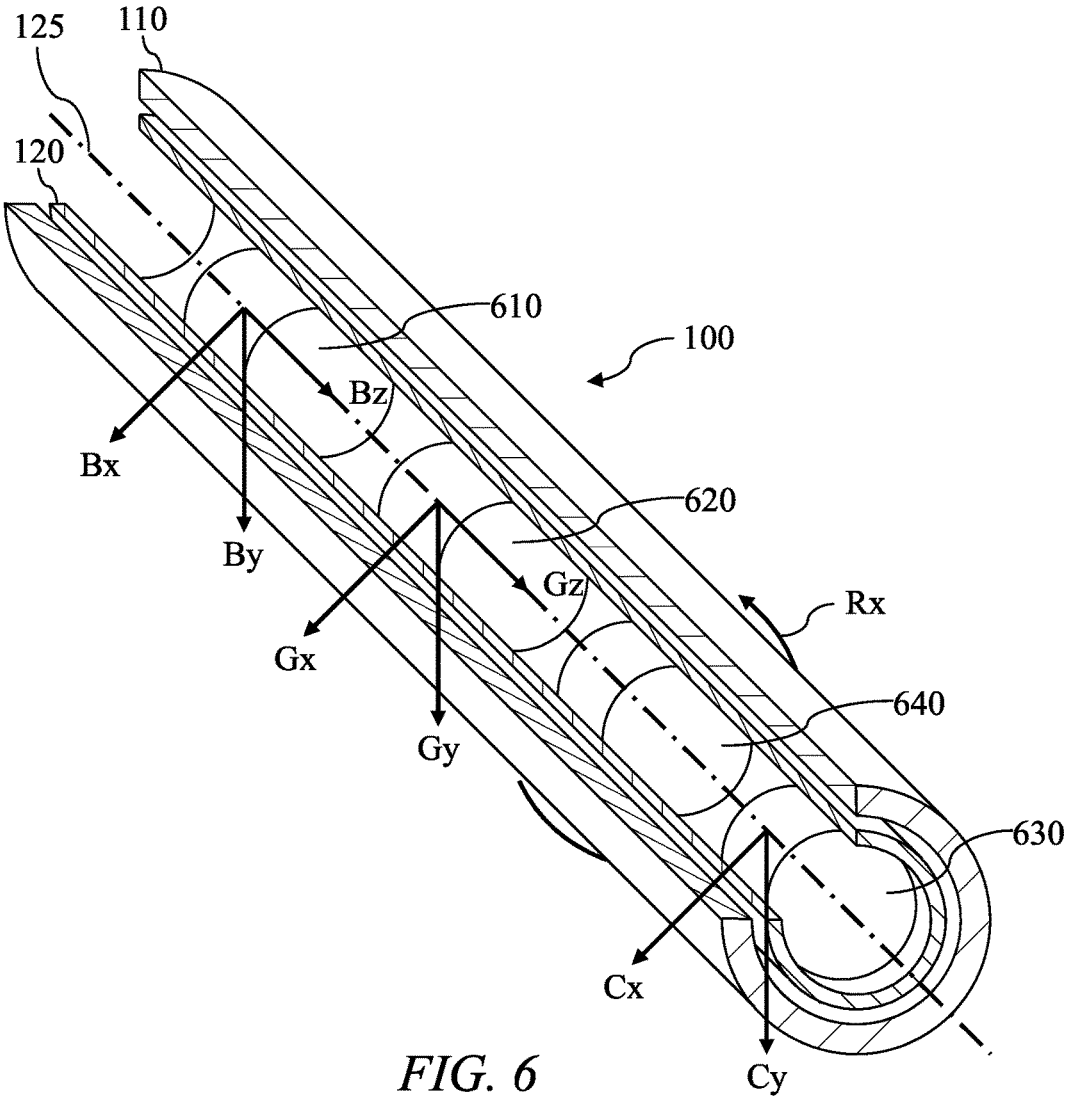
FIG. 6 is a schematic view of an example implementation of a portion of the apparatus shown in FIG. 1, 2, or 3.

FIG. 6 is a schematic view of a portion of an example implementation of one or more of the apparatuses 100, 200, 300, 525 shown in FIGS. 1-3 and 5 according to one or more aspects of the present disclosure. As shown in FIG. 6, the apparatus 100 may comprise a roll-stabilized pressure casing 120, which may contain one or more magnetometers 610, one or more accelerometers 620, one or more magnetic components 630, and one or more gyro sensors 640.

The one or more magnetometers 610 may comprise one or more three-axis magnetometers operable to measure a local magnetic field along axes Bx, By, and Bz with reference to an orientation of the roll-stabilized pressure casing 120. The one or more accelerometers 620 may comprise one or more three-axis accelerometers operable to measure gravitational force along axes Gx, Gy, and Gz with reference to the axis 125 of the roll-stabilized pressure casing 120. The one or more magnetic components 630 may comprise two-axis magnetometers operable to measure rotational speed and position of the roll-stabilized pressure casing 120 along axes Cx and Cy relative to the housing 110. The one or more gyro sensors 640 may comprise a roll rate gyro operable to measure the roll rate Rx of the roll-stabilized pressure casing 120 about its axis 125. One or more aspects of the present disclosure may be applicable or readily adaptable to roll-stabilized apparatus that may exhibit one or more differences relative to the example apparatus described herein and/or shown in the figures.

In view of the entirety of the present disclosure, including the figures and the claims, a person having ordinary skill in the art will readily recognize that the present disclosure introduces an apparatus comprising: a downhole steering tool conveyed in a wellbore via a drill string, wherein the downhole steering tool comprises: a first member fixedly coupled with the drill string; a second member disposed proximate the first member and rotatable substantially freely with respect to the first member; a first sensor operable to measure a difference in rotation rates of the first and second members; a second sensor operable to measure a substantially real-time rotation rate of the second member in the wellbore; and a tool controller operable to process sensor signals from the first and second sensors to determine a rotation rate of the drill string.

The first member may be a collar and second member may be a roll-stabilized sensor housing disposed within the collar. In such implementations, the roll-stabilized sensor housing may be a slowly-rotating sensor housing or a non-rotating sensor housing.

The first member may be or comprise a shaft and the second member may be or comprise a roll-stabilized sensor housing disposed about the shaft. In such implementations, the roll-stabilized sensor housing is a slowly-rotating sensor housing or a non-rotating sensor housing.

The second member may be or comprise a roll-stabilized sensor housing. In such implementations, the roll-stabilized sensor housing may be a slowly-rotating sensor housing or a non-rotating sensor housing.

The wellbore may extend from a wellsite surface to a subterranean formation, and the tool controller may be further operable to interpret downlink signals transmitted from the wellsite surface as predefined variations in the rotation rate of the drill string.

The first sensor may be coupled with the first member or the second member, and the second sensor may be coupled with the second member.

The second sensor may be or comprise at least one of an accelerometer, a magnetometer, and/or a gyroscopic sensor.

The first member may be a collar, the second member may be a roll-stabilized sensor housing disposed within the collar, and the first sensor may comprise a rotation sensor disposed on the roll-stabilized sensor housing and operable in conjunction with a marker disposed on the collar.

The first member may be a collar, the second member may be a roll-stabilized sensor housing disposed within the collar, and the first sensor may comprise one or more rotation sensors each selected from the group consisting of: an infrared sensor, an ultrasonic sensor, a Hall-effect sensor, a fluxgate magnetometer, a magneto-resistive sensor, a MEMS magnetometer, and a pick-up coil.

The tool controller may be further operable to decode an encoding language comprising codes that are represented in the encoding language as predefined sequences of varying rotation rates of the drill string to communicate with a surface location to control the downhole steering tool. In such implementations, the apparatus may further comprise a surface controller operable at the surface location to send downlink codes to the tool controller in the form of a predefined sequence of varying rotation rates of the drill string to control the downhole steering tool. Moreover, the downhole steering tool may be part of a rotary-steerable system, and the tool controller may be operable to process the sensor signals and decode the encoding language while the rotary-steerable system is operated to elongate the wellbore.

The present disclosure also introduces a method comprising: deploying a drill string in a subterranean wellbore, wherein the drill string includes a drill bit and a steering tool, and wherein the steering tool comprises: a first member coupled with the drill string; a second member operable to rotate substantially freely with respect to the first member; a rotation measurement device operable to measure relative rotation rate between the first member and the second member; and a sensor operable to measure the rotation rate of the second member; rotating the drill string at a first rotation rate; and transmitting a signal to the steering tool by: rotating the drill string at a second rotation rate for a first predetermined period of time, wherein the second rotation rate is substantially different than the first rotation rate; and rotating the drill string at a third rotation rate for a second predetermined period of time, wherein the third rotation rate is substantially different than the first and second rotation rates.

Rotating the drill string at the first rotation rate may cause the drill bit to elongate the wellbore. The second rotation rate may be near zero and/or less than about ten revolutions per minute.

The first predetermined period of time may range between about thirty and about sixty seconds, and the second predetermined period of time may be about 120 seconds.

The second rotation rate may differ from each of the first and third rotation rates by at least about ten revolutions per minute.

The present disclosure also introduces an apparatus comprising: a downhole steering tool conveyed in a wellbore via a drill string, wherein the downhole steering tool comprises: a first member fixedly coupled with the drill string; a second member disposed proximate the first member and rotatable substantially freely with respect to the first member; a first sensor operable to measure a difference in rotation rates of the first and second members; a second sensor operable to measure a substantially real-time rotation rate of the second member in the wellbore; and a tool controller operable to: process sensor signals from the first and second sensors to determine a rotation rate of the drill string; and decode an encoding language comprising codes that are represented in the encoding language as predefined sequences of varying rotation rates of the drill string to communicate with a surface location to control the downhole steering tool; and a surface controller operable at the surface location to send downlink codes to the tool controller in the form of a predefined sequence of varying rotation rates of the drill string to control the downhole steering tool.

The wellbore may extend from a wellsite surface to a subterranean formation, and the tool controller may be further operable to interpret downlink signals transmitted from the wellsite surface as predefined variations in the rotation rate of the drill string, wherein the downlink signals may be encoded with the encoding language as the predefined variations. The downhole steering tool may be part of a rotary-steerable system, and the tool controller may be operable to process the sensor signals and decode the encoding language while the rotary-steerable system is operated to elongate the wellbore.

The foregoing outlines features of several embodiments so that a person having ordinary skill in the art may better understand the aspects of the present disclosure. A person having ordinary skill in the art should appreciate that they may readily use the present disclosure as a basis for designing or modifying other processes and structures for carrying out the same functions and/or achieving the same benefits of the embodiments introduced herein. A person having ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. §1.72(b) to allow the reader to quickly ascertain the nature of the technical disclosure. It is submitted with the understanding that it will not be used to interpret or limit the scope or meaning of the claims.

What is claimed is:

1. An apparatus, comprising:

a downhole steering tool conveyed in a wellbore via a drill string, the downhole steering tool deployed between a drilling motor and a drill bit in the drill string, wherein the downhole steering tool comprises:

a collar fixedly coupled with the drill string;

a roll-stabilized sensor housing deployed in the collar and disposed to rotate freely with respect to the collar, the roll-stabilized housing deployed axially between first and second torquers configured to apply torque to the roll-stabilized housing;

a first sensor operable to measure a difference in rotation rates between the collar and the roll-stabilized housing, the first sensor including a magnetic marker deployed on the collar and a magnetic sensor deployed in the roll-stabilized housing;

a second sensor deployed in the roll-stabilized housing and operable to measure a rotation rate of the roll-stabilized housing in the wellbore; and a tool controller deployed in the roll-stabilized housing and operable to process sensor signals from the first and second sensors to determine a rotation rate of the drill string and (ii) decode an encoding language comprising codes that are represented in the encoding language as predefined sequences of varying rotation rates of the drill string to receive commands from a surface location to control the downhole steering tool; and a surface controller operable at the surface location to send downlink codes to the tool controller in the form of a predefined sequence of varying rotation rates of the drill string to control the downhole steering tool, wherein the predefined sequence of varying rotation rates of the drill string are achieved via modulation of a drilling fluid flow rate in the drill string to modulate a rotation rate of the drilling motor and thereby modulate a rotation rate of the collar.

2. The apparatus of claim 1 wherein the roll-stabilized sensor housing has a rotation rate with respect to the wellbore that is less than a rotation rate of the drill string.

3. The apparatus of claim 1 wherein the roll-stabilized sensor housing is non-rotating with respect to the wellbore.

4. The apparatus of claim 1 wherein the second sensor is or comprises at least one of an accelerometer, a magnetometer, and/or a gyroscopic sensor.

5. The apparatus of claim 1 wherein the downhole steering tool is part of a rotary-steerable system, and wherein the tool controller is operable to process the sensor signals and decode the encoding language while the rotary-steerable system is operated to elongate the wellbore.

6. The apparatus of claim 1, wherein the magnetic sensor deployed in the roll-stabilized housing comprises a magnetometer.

7. The apparatus of claim 6, wherein the magnetometer comprises a two-axis magnetometer.

8. The apparatus of claim 1, wherein the tool controller is further operable to receive said modulating the drilling fluid flow rate at one or both of the first and second torquers and to correlate said modulating the drilling fluid flow rate with said varying rotation rates to decode the encoding language.

9. A method, comprising:

(a) deploying a drill string in a subterranean wellbore, wherein the drill string includes a steering tool deployed between a drilling motor and a drill bit, and wherein the steering tool comprises:

a collar coupled with the drill string;

a roll-stabilized sensor housing deployed in the collar and disposed to rotate freely with respect to the collar, the roll-stabilized housing deployed axially between first and second torquers configured to apply torque to the roll-stabilized housing;

a rotation measurement device operable to measure relative rotation rate between the collar and the roll-stabilized housing, the rotation rate measurement device including a magnetic marker deployed on the collar and a magnetic sensor deployed in the roll-stabilized housing; and a sensor deployed in the roll-stabilized housing and operable to measure the rotation rate of the roll-stabilized housing in the wellbore;

(b) rotating the drill string at a first rotation rate, wherein rotating the drill string at the first rotation rate rotates the collar at the first rotation rate; and (c) transmitting a signal to the steering tool by:

modulating a drilling fluid flow rate in the drill string to modulate a rotation rate of the drilling motor and thereby modulate a rotation rate of the collar such that the collar rotates at a second rotation rate for a first predetermined period of time, wherein the second rotation rate is different than the first rotation rate and rotating the drill string at a third rotation rate for a second predetermined period of time, wherein the third rotation rate is different than the first and second rotation rates.

10. The method of claim 9 wherein the second rotation rate differs from each of the first and third rotation rates by at least ten revolutions per minute.

11. The method of claim 9, further comprising:

(d) causing a tool controller located in the steering tool to receive the signal transmitted in (c) by:

processing sensor signals from the rotation measurement device and the sensor to measure said modulated rotation rate of the collar;

receiving said modulating the drilling fluid flow rate at one or both of the first and second torquers; and correlating said modulating the drilling fluid flow rate with said modulated rotation rate of the collar to decode the signal transmitted in (c).

12. An apparatus, comprising:

a downhole steering tool conveyed in a wellbore via a drill string, the downhole steering tool is deployed between a drilling motor and a drill bit in the drill string, wherein the downhole steering tool comprises:

a collar fixedly coupled with the drill string;

a roll-stabilized sensor housing deployed in the collar and disposed to rotate freely with respect to the collar, the roll-stabilized housing deployed axially between first and second torquers configured to apply torque to the roll-stabilized housing;

a first sensor operable to measure a difference in rotation rates between the collar and the roll-stabilized housing, the first sensor including a magnetic marker deployed on the collar and a magnetic sensor deployed in the roll-stabilized housing;

a second sensor deployed in the roll-stabilized housing and operable to measure a rotation rate of the roll-stabilized housing in the wellbore;

a tool controller deployed in the roll-stabilized housing and operable to:

process sensor signals from the first and second sensors to determine a rotation rate of the drill string; and decode an encoding language comprising codes that are represented in the encoding language as predefined sequences of varying rotation rates of the drill string to communicate with a surface location to control the downhole steering tool; and a surface controller operable at the surface location to send downlink codes to the tool controller in the form of a predefined sequence of varying rotation rates of the drill string to control the downhole steering tool; the surface controller being operable to automatically control the sequence of varying rotation rates of the drill string to send downlink codes to the to the steering tool, wherein the surface controller is configured to send the downlink codes to the tool controller in the form of a predefined sequence of varying rotation rates via modulating a drilling fluid flow rate in the drill string, the modulating operative to modulate a rotation rate of the drilling motor and thereby modulate a rotation rate of the collar.

13. The apparatus of claim 12 wherein the wellbore extends from a wellsite surface to a subterranean formation, and wherein the tool controller is further operable to interpret downlink signals transmitted from the wellsite surface as predefined variations in the rotation rate of the drill string, wherein the downlink signals are encoded with the encoding language as the predefined variations.

14. The apparatus of claim 13 wherein the downhole steering tool is part of a rotary-steerable system, and wherein the tool controller is operable to process the sensor signals and decode the encoding language while the rotary-steerable system is operated to elongate the wellbore.

15. The apparatus of claim 12, wherein the tool controller is further operable to a filter the rotation rate of the drill string via a digital filter.

16. The apparatus of claim 12, wherein the tool controller is further operable to receive said modulating the drilling fluid flow rate at one or both of the first and second torquers and to correlate said modulating the drilling fluid flow rate with said varying rotation rates to decode the encoding language.

* * * * *